US008732978B2

(12) United States Patent
Kuan

(10) Patent No.: US 8,732,978 B2
(45) Date of Patent: May 27, 2014

(54) DRYING SILICON PARTICLES AND RECOVERING SOLVENT

(76) Inventor: Yuji Richard Kuan, Plano, TX (US)

( * ) Notice: Subject to any disclaimer, the term of this patent is extended or adjusted under 35 U.S.C. 154(b) by 233 days.

(21) Appl. No.: 13/485,545

(22) Filed: May 31, 2012

(65) Prior Publication Data

US 2012/0304486 A1 Dec. 6, 2012

Related U.S. Application Data

(60) Provisional application No. 61/492,651, filed on Jun. 2, 2011.

(51) Int. Cl.
*F26B 3/02* (2006.01)

(52) U.S. Cl.
USPC ..... 34/381; 34/201; 34/218; 239/303; 239/398; 428/300.1; 428/308.4

(58) Field of Classification Search
USPC ..... 34/381, 443, 201, 210, 218; 423/477; 239/303, 398, 407; 428/300.1, 300.7, 428/308.4; 422/189
See application file for complete search history.

(56) References Cited

U.S. PATENT DOCUMENTS 7,611,753 B2 * 11/2009 Bartkowiak et al. ..... 427/393.6
7,799,567 B1 * 9/2010 Call ..... 436/53
2001/0000145 A1 * 4/2001 Kalenian ..... 426/433
2002/0137871 A1 * 9/2002 Wheeler et al. ..... 528/44
2004/0010933 A1 * 1/2004 Mertens et al. ..... 34/380
2005/0079124 A1 * 4/2005 Sanderson ..... 423/477
2005/0115671 A1 * 6/2005 Araki ..... 156/345.12
2011/0042202 A1 * 2/2011 Pettee et al. ..... 204/228.2
2012/0304486 A1 * 12/2012 Kuan ..... 34/443

FOREIGN PATENT DOCUMENTS

EP 1160179 A1 * 12/2001 ..... B65D 83/30
GB 595936 * 12/1947
GB 1450170 A * 9/1976
JP 08123003 A * 5/1996 ..... G03D 13/00

* cited by examiner

*Primary Examiner* — Steve M Gravini
(74) *Attorney, Agent, or Firm* — Aka Chan LLP

(57) ABSTRACT

Apparatus to dry milled silicon particles has solvent spray nozzles, solvent drainage, gas inlet, and gas exhaust. This drying can occur, for example, following an acid etch and a deionized water rinse. The drying apparatus is an enclosed system with a lid that contains a solvent feeding tube and exhaust ventilation. This enclosed system design creates an effective low temperature drying system in an inert atmosphere. The apparatus can handle a variety of different particle sizes, inhibits the growth of surface oxides on the particles by using lower temperatures, and allows reuse of solvent.

15 Claims, 2 Drawing Sheets

DRYING SILICON PARTICLES AND RECOVERING SOLVENT

CROSS-REFERENCE TO RELATED APPLICATION

This patent application claims the benefit of U.S. provisional patent application 61/492,651, filed Jun. 2, 2011, which is incorporated by reference along with all other references cited in this application.

BACKGROUND OF THE INVENTION

This invention relates to the field of chemistry. More particularly, this invention is a technique of drying milled silicon particles.

In other methods to produce trihalosilane, a polycrystalline silicon chunk is cleaned following an acid etch. The polycrystalline silicon chunk is housed in a polyethylene basket and moved from an acid cleaning tank to a pure water rinsing tank. The cleaned silicon is then placed in a hot air dryer of about 70 degrees Celsius.

Existing methods have disadvantages such as:

(1) When the gaps between grills in the polyethylene basket are too big to hold the small silicon particle in the basket, the milled silicon particles will simply drop through.

(2) When being dried by the hot air dryer, the heat promotes the growth of resistance surface oxide.

Therefore, there is a need for an improved method of drying silicon particles.

BRIEF SUMMARY OF THE INVENTION

An apparatus is designed to dry milled silicon particles (such as metallurgical grade silicon), granulated polycrystalline silicon. This drying can occur, for example, following an acid etch and a deionized water rinse. The size of these silicon particles can be from about 100 microns to 1000 microns large (e.g., in another implementation, about 100 to 600 microns). The drying apparatus is an enclosed system with a lid that contains within a solvent feeding tube and exhaust ventilation. Additional tubes may be included to allow multiple solvents. This enclosed system design creates an effective low temperature drying system in an inert atmosphere (e.g., filled with nitrogen gas).

Advantages of the invention include:

(1) Referring to FIG. 1, solid wall polyethylene container 103 with surfactant-treated porous plastic plate 107 at the bottom allows free drainage of acids solution and rinsing water while retaining milled silicon particle 109.

(2) The moist cleaned silicon particle is then sprayed with volatile organic solvent (e.g., methanol or isopropyl alcohol). The solvent wetted silicon particle is then dried by blowing warm, dry nitrogen gas (about 35-50 degrees Celsius) from bottom to top.

(3) The bottom-to-top motion of nitrogen gas flow protects the porous plastic bottom plate from clogging by pushing up any trapped small silicon particle.

(4) The flammable organic solvent fume can be recycled (or reused) by passing through a water-chilled condenser. The enclosed drying system design eliminates flammable solvent exposure and any potential fire risk.

This solves the problems of:

(1) Needing to filter the acid solution and deionized cleansing water from the silicon particles.

(2) Surface oxidation growth on the silicon particles due to hot air and moisture exposure during drying.

(3) Consuming large quantities of volatile organic solvent by installing an enclosed, recyclable drying system.

In an implementation, a apparatus includes: a container to hold particles, where a bottom of the container, beneath the particles, is hydrophilic and comprises pores; a solvent inlet is connected to upper nozzles (e.g., spray nozzles), where the upper nozzles are positioned above the container holding the particles, and a flow of a fluid solvent is from the upper nozzles through the particles and through the pores at the bottom of the container; and a gas inlet tube is connected to a gas input nozzle, wherein the gas input nozzle is coupled to a bottom nozzle (e.g., input and output port) that emits gas from below the container holding particles, a flow of gas is from the bottom nozzle through the pores at the bottom of the container and through the particles, and the flow of gas is opposite of to the flow of solvent.

In various implementations, a solvent drainage valve is connected to the bottom nozzle. The flow of a fluid solvent is through the pores at the bottom of the container and through the bottom nozzle. The bottom of the container includes a porous plastic sheet. The pores are about 50 microns in pore size. The porous plastic sheet has a thickness of about 15 millimeters.

A gas heater is connected between the gas input nozzle and the bottom nozzle. The gas heater heats gas being input through gas input nozzle while it is flowed to the bottom nozzle. The gas heater warms a gas from about 35 to about 50 degrees Celsius (e.g., at least 35 degrees Celsius).

A gas valve is connected between the gas input nozzle and the bottom nozzle. The gas valve can be turned on and off independently of the solvent drainage valve. In a first operational state, the solvent drainage valve is on while the gas valve is off. In a second operational state, the solvent drainage valve is off while the gas valve is on. In these operational states, both valves are not both on at the same time.

In another implementation, a method includes: providing a container having pores at a bottom of the container; positioning the bottom of the container above a bottom nozzle; turning on a drainage valve connected to the bottom nozzle; turning off a gas valve connected to the bottom nozzle; from a spray nozzle above a container, spraying a solvent on the container of silicon particles until the silicon particles are wet; turning off the drainage valve connected to the bottom nozzle; turning on a gas valve coupled to the bottom nozzle; and from a gas input nozzle, inputting gas through the gas valve, a gas heater, and the bottom nozzle through the pores at the bottom of the container.

In various implementations, an exhaust port for the gas is provided in a lid above the container. The gas heater heats a gas to at least about 35 degrees before passing the gas through the bottom nozzle. The solvent is a liquid. The bottom of the container comprises pores of about about 50 microns in size. An enclosure lid is positioned above the container to prevent outgassing of flammable, volatile organic solvent from releasing into the surrounding area causing fire hazard. A vent gas exhaust is housed in the enclosure lid connects to a cold trap downstream to recover volatile solvent.

Various applications includes a method of making solar panels including an apparatus or method as described in this application. A method of photovoltaic processing including an apparatus or method as described in this application. A method of semiconductor processing including an apparatus or method as described in this application.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
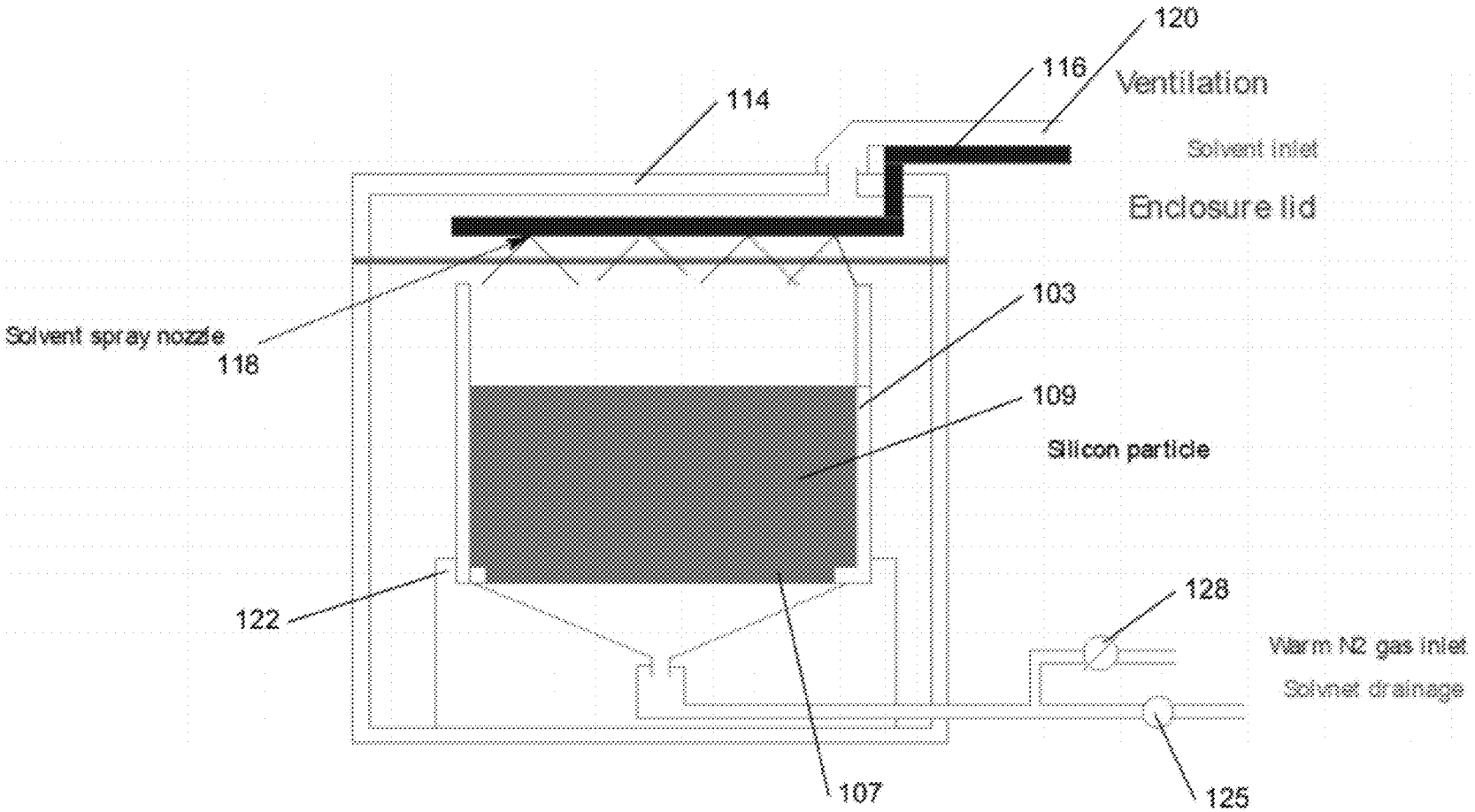
FIG. 1 shows an implementation of the invention.

FIG. 1 shows a sample implementation of the invention. The construction of the components of this implementation includes:

(1) Construction of silicon particle container (103). The bottom of a solid wall polyethylene container is cut off and replaced with porous plastic (or polymer) sheet 107 (e.g., about 50-micron pore size and about 15 millimeters thick). The porous plastic sheet is treated with supplier's surfactant to convert the porous plastic surface from hydrophobic to hydrophilic to facilitate aqueous solution filtration.

(2) Construction of the enclosure lid (114). The enclosure lid contains a solvent feeding tube 116, spraying nozzle 118, and vent gas exhaust 120.

(3) Construction of container/drying gas input module. The silicon container seamlessly sits on a hollow supporting bench 122. Excess solvent can drip down the porous plastic sheet, and drain out through a pneumatic valve 125 where the solvent is collected for recycling or reuse. During the drying stage, this solvent drain pneumatic valve is closed. Another pneumatic valve 238, that controls the on/off of nitrogen gas, is open. A nitrogen gas heater is installed upstream to warm the nitrogen gas to about 35-50 degrees Celsius. Other gases than nitrogen can be substituted.

Figure 2:
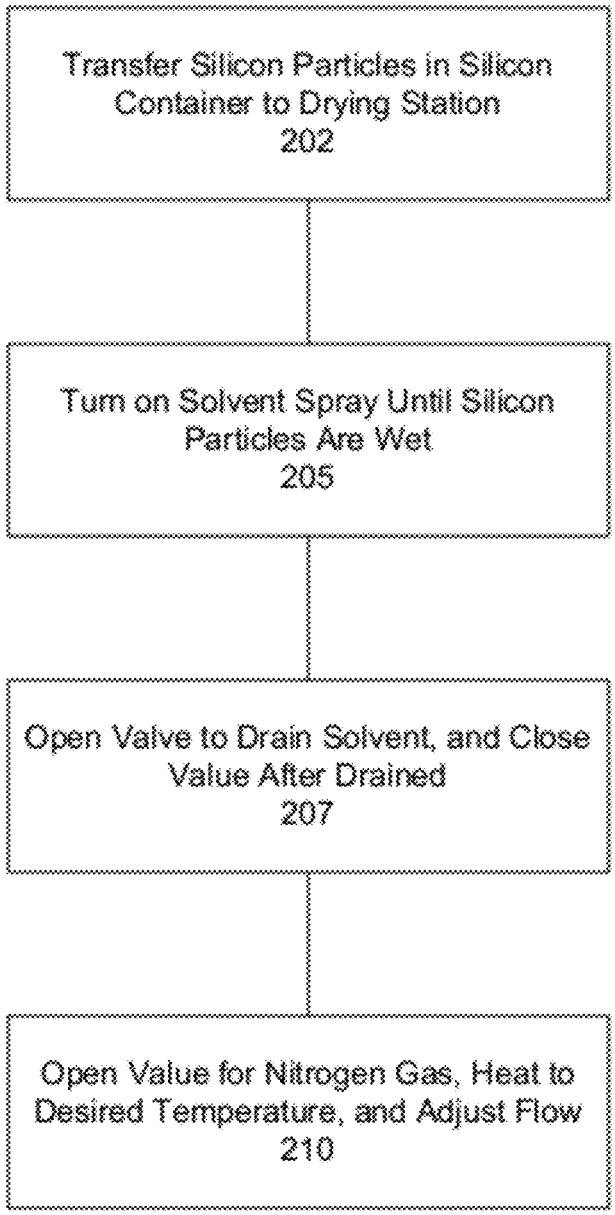
FIG. 2 shows an operation flow.

Referring to a FIG. 2, a sample flow of operation for an implementation of the invention is:

a) In a step 202, transfer silicon container to drying station, verify the container sits seamless on top of the supporting bench.

b) In a step 205, turn-on solvent spray for one minute or until all the silicon particles are wet with solvent.

c) In a step 207, open the pneumatic valve on the solvent drainage.

d) close the solvent drainage valve one minute after solvent spray stop or when there are no longer signs of excess solvent drippage.

e) In a step 210, open nitrogen purge valve, set the nitrogen gas heater to the desired temperature. The nitrogen flow rate is adjusted to the desired level.

f) continue to purge the silicon particle with warm nitrogen gas until the silicon particles are dry.

g) remove the dried silicon particles and transfer to a nitrogen filled bag for further processing or storage.

This sample flow is for illustrative purposes only. Persons of skill in the art would appreciate that the flow may include additional, fewer, or modified steps.

The invention provides the benefits of:

(1) The ability to handle small silicon particles.

(2) Drying under warm, inert atmosphere inhibits surface oxide growth.

(3) Low organic solvent consumption rate, since solvent can be collected for recycling or reuse.

This invention provides an apparatus to filter and dry small silicon particles without altering the etched and Si—H passivated silicon surface. The lower level of solvent consumption lowers the total cost of operation for the invention.

The apparatus described in this patent application can be used in the manufacture of silicon or polysilicon and applications of these materials, include semiconductor processing, semiconductor devices, photovoltaic processing, solar cells and panels, and others.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. An apparatus comprising:

a container to hold particles, wherein a bottom of the container, beneath the particles, is hydrophilic and comprises pores;

a solvent inlet coupled to a plurality of upper nozzles, wherein the upper nozzles are positioned above the container holding the particles, and a flow of a fluid solvent is from the upper nozzles through the particles and through the pores at the bottom of the container; and a gas inlet tube coupled to a gas input nozzle, wherein the gas input nozzle is coupled to a bottom nozzle that emits gas from below the container holding particles, a flow of gas is from the bottom nozzle through the pores at the bottom of the container and through the particles, and the flow of gas is opposite of to the flow of solvent.

2. The apparatus of claim 1 comprising:

a solvent drainage valve coupled to the bottom nozzle, wherein the flow of a fluid solvent is through the pores at the bottom of the container and through the bottom nozzle.

3. The apparatus of claim 1 wherein the bottom of the container comprises a porous plastic sheet comprises about 50-micron pore size and at least a thickness of about 15 millimeters.

4. The apparatus of claim 1 comprising:

a gas heater coupled between the gas input nozzle and the bottom nozzle, wherein the gas heater heats gas flowing through to the bottom nozzle.

5. The apparatus of claim 4 wherein the gas heater warms a gas from about 35 to about 50 degrees Celsius.

6. The apparatus of claim 2 comprising:

a gas valve, coupled between the gas input nozzle and the bottom nozzle.

7. A method comprising:

providing a container comprising pores at a bottom of the container;

positioning the bottom of the container above a bottom nozzle;

turning on a drainage valve coupled to the bottom nozzle;

turning off a gas valve coupled to the bottom nozzle;

from a spray nozzle above a container, spraying a solvent on the container of silicon particles until the silicon particles are wet;

turning off the drainage valve coupled to the bottom nozzle;

turning on a gas valve coupled to the bottom nozzle; and from a gas input nozzle, inputting gas through the gas valve, a gas heater, and the bottom nozzle through the pores at the bottom of the container.

8. The method of claim 7 comprising:

providing an exhaust port for the gas in a lid above the container.

9. The method of claim 7 using the gas heater, heating a gas to at least about 35 degrees before passing the gas through the bottom nozzle.

10. The method of claim 7 wherein the solvent is a liquid.

11. The method of claim 7 wherein the bottom of the container comprises pores of about about 50 microns in size.

12. The method of claim 7 comprising:

positioning an enclosure lid above the container to prevent outgassing of flammable, volatile organic solvent from releasing into the surrounding area causing fire hazard.

13. The method of claim 7 comprising:

providing a vent gas exhaust housed in the enclosure lid connects to a cold trap downstream to recover volatile solvent.

14. A method of making solar panels comprising the method of claim 1.

15. A method of photovoltaic processing comprising the method of claim 1.

* * * * *